United States Patent [19]

Cooper et al.

[11] 4,221,382

[45] Sep. 9, 1980

[54] SPORTS RACKET

[75] Inventors: Adrianus A. G. Cooper; Phillip M. Leopold, both of Alliance, Ohio

[73] Assignee: Pepsico, Inc., Purchase, N.Y.

[21] Appl. No.: 879,312

[22] Filed: Feb. 21, 1978

[51] Int. Cl.[2] ..... A63B 49/10

[52] U.S. Cl. ..... 273/73 F

[58] Field of Search ..... 273/73 R, 73 C, 73 F, 273/DIG. 7, DIG. 23, 80 R, 80 B, 80.9; 43/18 GF; 138/124, 125, 129, 130, 137, 144, 150, 154, DIG. 2; 428/35, 36, 109–114, 364, 367, 371, 376, 377, 902

[56] References Cited

U.S. PATENT DOCUMENTS

| | | | |
|---|---|---|---|
| 1,973,756 | 9/1934 | Gish | 138/130 X |
| 2,878,020 | 3/1959 | Robinson | 273/73 F |
| 3,212,528 | 10/1965 | Haas | 138/130 |
| 3,457,962 | 7/1969 | Shobert | 273/DIG. 7 |
| 3,491,999 | 1/1970 | Lindler | 273/DIG. 7 |
| 3,574,104 | 4/1971 | Medler | 273/DIG. 7 |
| 3,646,610 | 2/1972 | Jackson | 273/DIG. 7 |
| 3,691,000 | 9/1972 | Kalnin | 273/DIG. 23 |
| 3,755,037 | 8/1973 | Erwin et al. | 273/73 F X |
| 3,969,557 | 7/1976 | Jenks | 273/73 F X |
| 3,993,308 | 11/1976 | Jenks | 273/73 F |
| 4,023,801 | 5/1977 | Van Auken | 273/DIG. 7 |
| 4,082,277 | 4/1978 | Van Auken | 273/80 R |

*Primary Examiner*—Richard J. Apley

[57] ABSTRACT

A composite sports racket frame having a head portion subject to loading is provided with an integral arrangement of resin impregnated braided tow tubes and a layer of tow disposed in wound fashion between part of the braided tows. A method of making a sports racket frame by winding a resin impregnated tow about part of a braided tow tube and placing a second braided tow tube to form an assembly that is internally pressurized and heat cured is disclosed.

4 Claims, 3 Drawing Figures

SPORTS RACKET

BACKGROUND OF THE INVENTION

This invention relates to improved composite articles subjected to noncontinuous loads which result in stress concentrations due to points of geometrical change within the article. More particularly, this invention relates to an improved composite sports racket for tennis, badminton, squash or the like, and to a method for fabricating the same.

Sports rackets used to strike or hit a ball or shuttlecock are typically composed of a handle and an open-faced racket head. The racket head is disposed at the upper part of the racket, generally in a form having an elliptical or oval shaped cross section. A network of stringing is strung in tension across the face of the racket head. Tensions creating forces in the string on the order of 45 to 65 pounds are said to produce excellent playing characteristics in tennis. It is important that the string stresses be evenly distributed throughout the structure to prolong string life and improve off center hits.

The strings are normally threaded through apertures in the head frame that are provided to accommodate the stringing. The apertures may be molded, punched, drilled or otherwise formed in the frame. The apertures represent abrupt changes in the geometry of the frame which inherently cause concentrations of stress and result in a substantial loss of strength in an area subjected to stress from both the static forces of string tension and the non-continuous dynamic forces resulting from impact and return of the balls. Hence, it is important to design the apertures so as to prevent localized deformation and string wear.

Fiber reinforced plastic or composite materials have been used to produce sports rackets with satisfactory playing characteristics. The high mechanical strengths and anisotropic characteristics of composites make these readily adaptable to withstanding the major bending and twisting forces to which sports rackets are subjected. The composite racket frames, moreover, are often formed in a one component construction obviating disadvantages of wood or metallic constructions that may variously use multiple pieces, rivets, welds or laminations which can loosen or break. Fabrication of stringholes in composite materials, however, will necessarily sever some of the fibers in the plastic matrix and result in fiber discontinuities at the stringholes. Because of these fiber discontinuities cracks, once developed, can readily propagate from stringhole to stringholes resulting in an overall decrease in the structural strength of frame and, consequently, in a decrease in durability.

Thus, there exists a need for a composite sports racket which retards the initiation and propagation of cracks in the area of the stringholes.

SUMMARY OF THE INVENTION

In accordance with the principles of the invention, a composite sports racket construction, resistant to crack initiation and propagation in the area of the stringholes, and a method for producing such a sports racket are presented.

The sports racket is provided with a head portion and handle portion. Resin impregnated tows braided into tubular shape form a first tubular layer. Further tow is wound about the part of the first tube which will serve as the head of the finished racket. A second braided tow tube, similar to the first, is placed about the first tube, including the part thereof having the wound tow. This assembly is internally pressurized by an inflatable bladder inserted into the first tube and cured in a heated mold to form the sports racket frame. In alternate embodiments, further tow strands are longitudinally disposed about the part of the inner tube, in parallel with its axis, which will serve as the handle of the sports racket.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
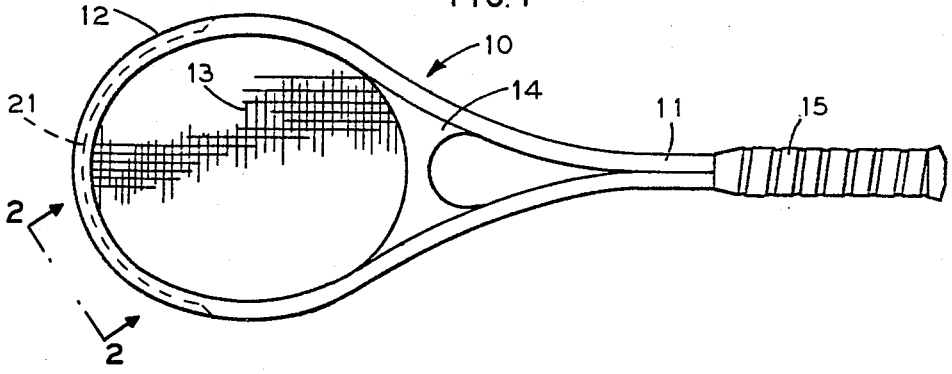
FIG. 1 is a front view of a sports racket made in accordance with the invention.

Referring now to the drawings in detail, FIG. 1 illustrates a sports racket 10 composed of a frame including a handle 11 and an open-faced racket head 12. A network of stringing 13 is strung across the face of the racket head 12. A throat member or yoke 14, such as described in U.S. Pat. No. 3,958,805 and assigned to the assignee of the present invention, is formed at the portion of the racket where the head 12 meets the handle 11. A grip 15 circumscribes part of the handle on the end opposite the head.

Figure 2:
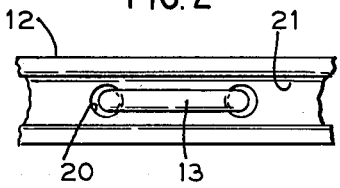
FIG. 2 is a side view of part of FIG. 1 taken along the lines 2—2.

Stringholes 20, as shown in FIG. 2, are formed in the racket head 12 normal to the axial length of the racket frame. A string groove 21 is generally provided in the head in order to recess the stringing 13 which is laced through the stringholes 20 and thereby protect the stringing from racket impacts with the playing court and the like. The stringing 13 is normally strung with a continuous length of string in each direction and is secured by tying a knot at the end of the stringing. The stringholes 20 may be lined with a grommet (not shown) made from nylon or another soft material to protect the string from edge abrasion at the stringholes.

Figure 3:
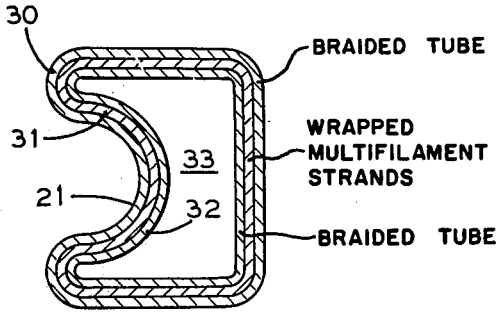
FIG. 3 is a schematic section of the layered construction of the racket head taken along line 3—3 of FIG. 1 prior to curing. It will of course be recognized that the layers of a completed frame are integrally molded and would not be readily discernible in an actual section of the head portion of a racket frame.

As is shown schematically in FIG. 3, the head 12 is essentially formed from a hollow tubular assembly composed of an outer layer 30, an intermediate layer 31 and an inner layer 32 of resin impregnated fibrous tows surrounding an internal hollow 33. The term "tow" as used in the specification and claims is meant to connote a twistless multifilament strand of continuous fibers which, except where qualified, has been pre-impregnated with a resin, preferably an epoxy. It should be understood, moreover, that the separate layers 30, 31, 32 are molded (as is described hereinafter) into an integral composite to form a finished sports racket frame, and that the initial separate layers are not generally discernible within the finished frame.

In the preferred embodiment, the outer layer 30 and inner layer 32 each includes a plurality of tows intertwined into a braided tube of sufficient length to incorporate the entire frame, that is, both the handle 11 and the head 12 of the sports racket. The intermediate layer 31 is composed of a continuous tow that has been circumferentially or spirally wrapped between the adjacent layers 30, 32 over part of the outside perimeter of the inner layer 32 and within the inside perimeter of the outer layer. In alternate embodiments, the intermediate layer may contain a plurality of tows. This structural arrangement results in a considerable increase in strength around the stringholes 20, and improved resistance to crack development and propagation therebetween. The braided tubes inherently exhibit torsional stiffness.

In the preferred embodiment the handle 11 is formed without the intermediate layer. An intermediate layer of unidirectional fiber strands may be formed in the handle 11, oriented parallel to the longitudinal axis between the braided inner and outer layers, to increase its bending stiffness and compressive load capacity. The unidirectional strands can be evenly distributed around the perimeter of inner braid or concentrated, for example at diametrically opposite positions to increase bending stiffness in a particular plane.

The hollow 33 (FIG. 3) may be filled with a suitable foam core. Tests conducted by pulling the stringing through two holes indicate, however, that a foam core does not have any significant influence in arresting cracks between stringholes once developed.

In the preferred embodiment of the invention, the braid in the braided layers is disposed at an angle in the range of twenty degrees to forty degrees relative to the lengthwise axis of the racket.

Tows consisting of two strands of 6000 graphite fiberspre-impregnated with epoxy resin with individual fiber diameter of eight microns and an overall tow width of 0.1 inches have been successfully utilized in fabricating sports rackets exhibiting improved strength and resistance to head stringhole cracking. The outer layer of braid was typically formed by braiding thirty-six tows into a tubular structure and the inner layer was formed by braiding thirty to thirty-six tows, depending upon the desired racket construction. The intermediate layer within the head has been formed with satisfactory results within a range of eight to ten circumferential wraps per inch of length. In other embodiments, glass fiber tows or tows of an aramid fiber, such as is sold under the trademark KEVLAR, or combinations of graphite and/or glass and/or aramid fiber tows may be utilized. It is preferred, but not essential, to achieve a fiber to resin ratio in the finished sports racket of 60 to 65 weight percent for graphite fiber reinforced tennis rackets, and of 68 to 72 weight percent for glass reinforced tennis rackets.

The sports racket of the invention may be produced as follows. A first length of braided tube, composed of a plurality of intertwined tows, which is slightly longer than the developed length of the racket frame, is pulled over a rod. This tube will constitute the inner layer. A tow is then circumferentially or spirally wound over the length of the braided tube that will be included within the head of the racket frame. The ends of the wound tow may be fixed to the inner braid with a point heat source, for example, by fusing with a soldering iron. The circumferentially wrapped tow constitutes the intermediate layer. A second tubular length of braided tow, having the same length as the first, is pulled over the first braided tube and the surrounding wrap. The second tube constitutes the outer layer. The rod is removed from the assembly and an inflatable bladder is inserted within the resulting hollow.

The assembly including the bladder is placed into a suitable mold, for example a matched die mold, which is designed to produce the desired shape of a sports racket frame. The mold is preferably preheated. The mold is closed and the bladder is inflated by internal fluid pressurization so as to press the assembly against the walls of the mold cavity and attain the desired cross sectional contour. A string groove may be impressed in the assembly by means of a slide pressing device, such as is known, which is pushed in after the mold has been closed and the bladder pressurized. The bladder pressure is maintained while the assembly is heat cured. After completion of the cure, the bladder is deflated, the mold opened, and the cured assembly is removed from the mold. The deflated bladder is removed from the assembly and may be substantially used. The assembly is subsequently deflashed and trimmed to the length of the desired frame.

It is not essential to preheat the mold but more rapid production cycles can be obtained by preheating. With the resin and fiber systems described hereinbefore, a bladder pressure of 160 psig, a mold temperature of 350° F. and a cure time of twenty minutes has been found to be sufficient. A bladder formed from a silicone rubber material or other material that is inert at the molding conditions is utilized.

As noted, rackets made in accordance with the principles of the invention were found to exhibit increased durability in comparison with rackets in which the intermediate wound layer was omitted and in comparison with commercially available rackets. Durability was established by rotating a racket at a tangential speed of approximately eighty miles per hour and dropping tennis balls in front of the racket through a mechanism timed such that a ball is impacted on the stringing to simulate playing conditions. The durability comparisons of tennis rackets made in accordance with this invention revealed that the rackets consistently displayed satisfactory performance with "no failure" in comparison with composite rackets not having circumferentially wrapped tow as an intermediate layer in the head, and in comparison with commercially available steel, composite and wood rackets. The term "no failure" indicates that the racket still performs satisfactorily as a tennis racket and hits the ball satisfactorily in the testing equipment. Small cracks which appeared on the surface of the racket but did not affect its performance were not considered failures. Major cracks generally resulted in immediate failure and fracture of the frame or pulling of the stringing through the outer wall of the racket between adjacent stringholes.

Composite rackets made in accordance with the invention exhibited little loss of stiffness relative to wood rackets, and some other composite and metal rackets commercially available. Loss of stiffness was measured by supporting the tennis racket at the top of the head and the end of the handle, and applying a load near the yoke area. The stiffness was determined by measuring the deflection of the racket by the application of a twenty pound force. As the deflection increased, the racket was characterized as losing stiffness.

Although the form of the sports racket illustrated in the drawings is of the so-called "open-throat" frame design, the racket frame could also be molded as a closed throat frame.

The resin can be applied to the tow prior to braiding so that the tow would be in prepreg form, or after (by wet or dry impregnation) or both if additional resin on the outside surface of the frame is desired to improve surface finish. The use of prepreg braid facilitates formation of multilayer tubes for added strength where desired, for example, in the handle.

The embodiments of the invention in which an exclusive property or privilege is claimed are defined as follows:

1. An improved one-component composite sports racket frame composed of fibers and resin of the type having a handle portion and an open-faced head portion with a plurality of stringholes to accommodate passage of a stringing strung across the face of the head portion, which is resistant to and retards crack initiation and propagation in the area of the stringholes, consisting essentially of: an inner tubular layer of braided resin impregnated tow, an outer tubular layer of braided resin impregnated tow disposed around the inner tubular layer of braided tow, and an intermediate layer of a resin impregnated tow in the form of a multifilament strand having an overall width of 0.1 inches spirally wrapped over the outside perimeter of the inner braided tube within the inside perimeter of the outer braided tube in the head portion of the racket frame, said intermediate layer having a range of eight to ten circumferential wraps per inch of length of said head portion, said layers of inner braided tube, outer braided tube and spirally wrapped intermediate tow are so constructed and arranged that they are molded into an integral plastic composite.

2. The improved sports racket frame of claim 1 wherein the tow includes a multifilament strand of continuous graphite fibers.

3. The improved sports racket frame of claim 1 wherein the tow includes a multifilament strand of continuous aramid fibers.

4. The improved sports racket frame of claim 1 wherin the tow includes a multifilament strand of continuous glass fibers.

* * * * *